US006020871A

United States Patent [19]

Asada

[11] Patent Number: 6,020,871

[45] Date of Patent: Feb. 1, 2000

[54] BIDIRECTIONAL SCANNING CIRCUIT

[75] Inventor: Hideki Asada, Tokyo, Japan

[73] Assignee: NEC Corporation, Tokyo, Japan

[21] Appl. No.: 08/977,058

[22] Filed: Nov. 25, 1997

[30] Foreign Application Priority Data

Nov. 27, 1996 [JP] Japan ..... 8-315763

[51] Int. Cl.[7] ..... G09G 3/36

[52] U.S. Cl. ..... 345/98; 345/100

[58] Field of Search ..... 345/87, 94, 99, 345/98, 100

[56] References Cited

U.S. PATENT DOCUMENTS 4,888,523 12/1989 Shoji et al. ..... 315/169.3
5,712,653 1/1998 Katoh et al. ..... 345/100
5,850,216 12/1998 Kwon ..... 345/204

FOREIGN PATENT DOCUMENTS 6-88971 3/1994 Japan .
7-134277 5/1995 Japan .
7-146462 6/1995 Japan .

*Primary Examiner*—Amare Mengistu
*Assistant Examiner*—Mansour M. Said
*Attorney, Agent, or Firm*—Sughrue, Mion, Zinn, Macpeak & Seas, PLLC

[57] ABSTRACT

A bidirectional scanning circuit can avoid malfunction of a signal and phase shift of the scanning pulse between IC chips. A rightward shifting input circuit and a leftward shifting output circuit are provided between a series connection point of series connected transfer gates and a first input/output terminal, and a rightward shifting output circuit and a leftward input circuit are provided between the series connection point and the second input/output terminal. By this, influence of the floating capacitors added to both ends of the series connected transfer gate group can be avoided to successfully prevent malfunction of the signal. Also, by connecting the first and second input/output terminals to input/output terminals of other IC chip, respectively, a high speed bidirectional scanning circuit can be established without causing phase shift of the scanning pulses between the chips by cascade connection of a plurality of IC chips.

10 Claims, 19 Drawing Sheets

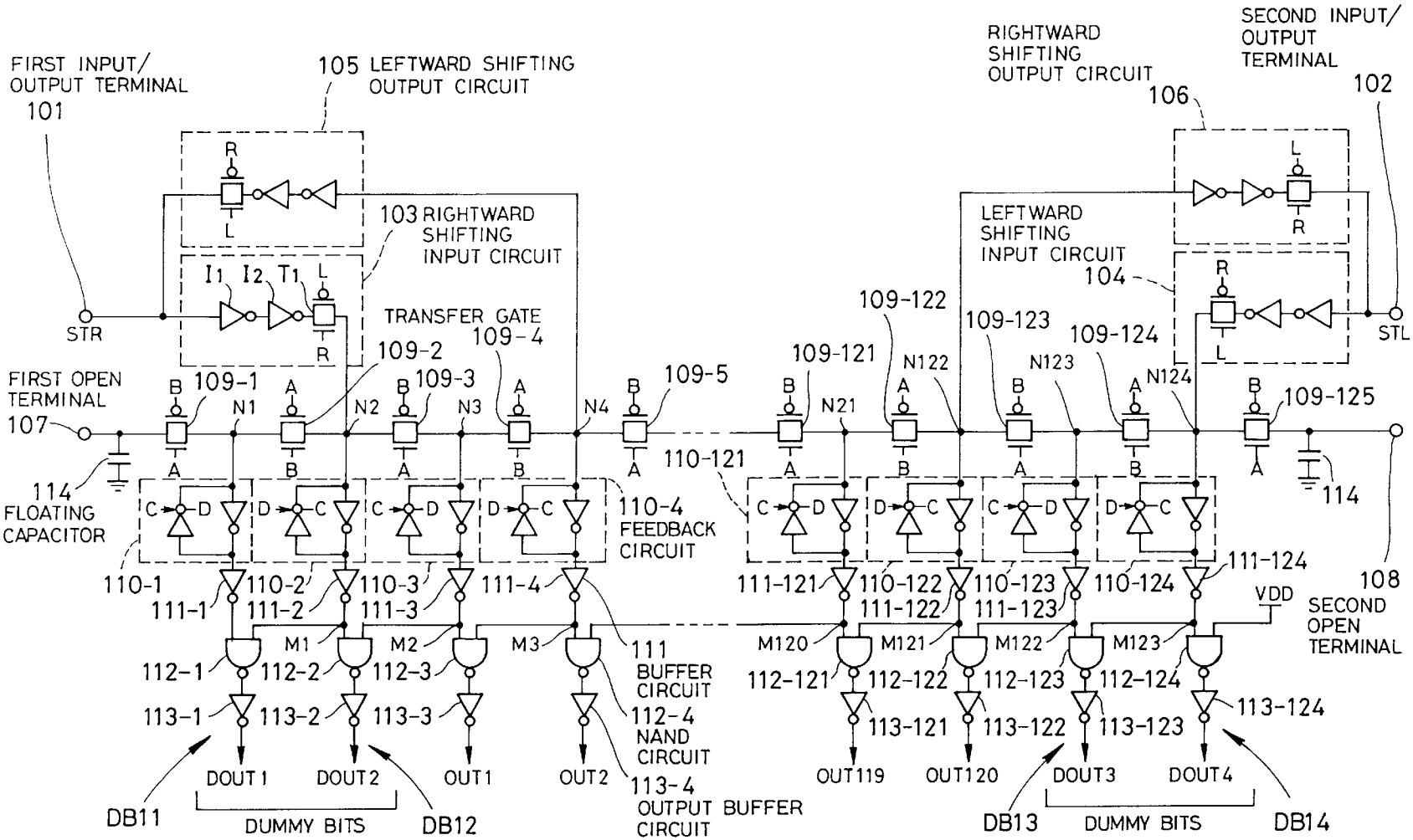
FIG.1
SECOND INPUT/ OUTPUT TERMINAL 102
STL
108 SECOND OPEN TERMINAL
RIGHTWARD SHIFTING OUTPUT CIRCUIT 106
LEFTWARD SHIFTING INPUT CIRCUIT 104
109-125
114
VDD
111-124
113-124
DB14
DOUT4
DUMMY BITS
DOUT3
DB13
DOUT120
OUT119
N124
109-124
110-124
M123
112-124
113-123
N123
109-123
110-123
111-123
M122
112-123
113-122
N122
109-122
110-122
111-122
M121
112-122
113-121
N21
109-121
111-121
M120
112-121
110-121
109-5
N4
110-4 FEEDBACK CIRCUIT
111 BUFFER CIRCUIT
112-4 NAND CIRCUIT
113-4 OUTPUT BUFFER CIRCUIT
OUT2
111-4
M3
OUT1
DB12
DOUT2
DUMMY BITS
DOUT1
DB11
N3
N2
N1
109-3
109-2
109-1
TRANSFER GATE 109-4
103 RIGHTWARD SHIFTING INPUT CIRCUIT
105 LEFTWARD SHIFTING OUTPUT CIRCUIT
I1 I2 T1
110-3
111-3
M2
112-3
113-3
110-2
111-2
M1
112-2
113-2
110-1
111-1
112-1
113-1
FIRST INPUT/ OUTPUT TERMINAL 101
STR
FIRST OPEN TERMINAL 107
114 FLOATING CAPACITOR

BIDIRECTIONAL SCANNING CIRCUIT

BACKGROUND OF THE INVENTION

1. Field of the Invention

The present invention relates to a scanning circuit. More specifically, the invention relates to a scanning circuit to be employed for a peripheral driver circuit such as for a liquid crystal display, a plasma display and so forth.

2. Description of the Related Art

For the purpose of down-sizing and reduction of cost of a liquid crystal display device, development of technology for integrating a peripheral driver circuit on a liquid crystal display substrate in common has been progressed. The peripheral driver circuit can be divided into a vertical driver circuit for scanning gates of thin film transistors (hereinafter referred to as TFT) forming an active matrix array and a horizontal driver circuit supplying a video signal to a data bus line. These peripheral driver circuits are typically formed by integrating polycrystalline silicon thin film transistor (hereinafter referred to as p-SiTFT). Among various circuit forming the peripheral driver circuit, a scanning circuit generating a gate scanning pulse signal or sampling pulse signal is one of important circuit components.

A task for the scanning circuit is, at first, speeding up for adapting for increasing of resolution of the liquid crystal display abruptly evolving. On the other hand, in order to adapt for higher function, such as display inverting function and so forth, a capability of bidirectional scanning is required.

Particularly, in case of a three panel type liquid crystal display employing three liquid crystal displays, it becomes necessary to provide a display inverting function of the liquid crystal display due to difference of number of times of mirror reflection. Therefore, a bidirectional scanning circuit is an essential circuit. As a construction of the bidirectional scanning circuit, a construction as disclosed in Japanese Unexamined Patent Publication No. Heisei 7-146462 has been employed.

However, such bidirectional circuit requires an additional circuit for switching a shifting direction, and thus, a circuit speed becomes lower than that of a unidirectional scanning circuit. On the other hand, in Japanese Unexamined Patent Publication No. Heisei 7-134277, a construction of a bidirectional scanning circuit operating at high speed has been disclosed. FIG. 15 discloses a circuit construction. In the shown circuit construction, number of outputs of the scanning circuit is assumed to be 120. As shown in FIG. 15, the shown circuit is constructed with transfer gates 109-1 to 109-121 mutually connected in series for transferring a signal from a former stage to a later stage with a delay by clock signals A and B, and feedback circuits 110-1 to 110-119 for preventing attenuation of an amplitude of a pulse signal transferred with a delay, and an output buffer circuits 113-1 to 113-119.

As shown in FIG. 15, the feedback circuit is constructed with an inverter and a clocked inverter. The clocked inverter is controlled activation by clock signals C and D. The detailed construction of the clocked inverter is as shown in FIGS. 14A and 14B.

Namely, in FIG. 14A, there is shown symbols of clocked inverter circuits (transistors T3 and T4) supplying the clock signals C and D to gates of respective of an n-channel transistor T2 and a p-channel transistor T1, and a circuit construction. On the other hand, in FIG. 14B, there is shown symbols of clocked inverter circuits (transistors T3 and T4) supplying the clock signals D and C to respective of an n-channel transistor T2 and a p-channel transistor T1.

The operation of this circuit will be discussed with reference to FIGS. 16 and 17. FIG. 16 is a timing chart of the case of rightward shifting. In case of rightward shifting, a start pulse STR is input to an input/output terminal 101 at a shown timing and a second input/output terminal 102 is held open. On the other hand, the clock signals A and D are taken as a common clock signal $\phi$, and the clock signals B and C are taken as a common clock signal for $\bar{\phi}$. Namely, the clocks A and B are complementary two phase signals, and also the C and D are complementary two phase signals. By setting as set forth above, a scanning pulse signal shifting from a scanning outputs OUT1 to OUT120 in sequential order can be output.

On the other hand, FIG. 17 shows a timing chart in the case of leftward shifting, the start pulse is input to the second input/output terminal 102 at a shown timing, and the first input/output terminal 101 is held open. On the other hand, the clock signals B and D are input as the common clock signal and the clock signals A and C are input as the common clock signal for $\bar{\phi}$. By thus setting, the scanning pulse signal shifting from OUT120 to OUT1 in sequential order can be output, as shown in FIG. 17.

As set forth above, by employing the circuit shown in FIG. 15, shifting direction can be switched without providing an additional circuit for switching the shifting direction.

It should be appreciated that in the example of FIG. 15, as shown in timing charts of FIGS. 16 and 17, shifting outputs respectively shifted in phase for half period of clocks A to D are lead out to the scanning outputs POUT1 to POUT120 in sequential order. However, in order to obtain shifting outputs having phase shift for one period of the clock, the shifting output may be lead out from respective scanning outputs in odd number.

While the bidirectional scanning circuit to be employed in a driver circuit integrated type liquid crystal display is described above, it has been considered, in the recent years, to apply the p-SiTFT driver circuit to a driver IC chip of the liquid crystal display or the plasma display. For example, Japanese Unexamined Patent Publication No. Heisei 6-88971 discloses an example where a driver IC chip fabricated by integrating the p-SiTFT driver circuit on a glass substrate, is directly mounted on a liquid crystal display. Even when the p-SiTFT driver circuit is applied for the driver IC chip, it is naturally required a bidirectional scanning circuit which can operate at high speed.

However, when J (J is a natural number) in number of the bidirectional scanning circuits are connected as the driver IC chip and a signal is transferred from the first chip to the chip in (J)th order, it can be caused a problem that an output at the final bit does not operate normally for the fact that the input/output terminal of the (J)th chip becomes a floating condition. Such malfunction is caused in the case where floating capacitors 114 of the input/output terminals 101 and 102 are greater in the order of one to two digits in comparison with a gate capacitance (10 to several hundreds fF) of the transistors forming the scanning circuit.

Therefore, when the bidirectional scanning circuit of FIG. 15 is employed alone, it becomes possible to prevent appearance of malfunction signal of the final bit on the input/output 102 by providing a dummy bit DB1 at the final bit as shown in FIG. 18. However, if such scanning circuit is applied as the driver IC chip, the following problems should be encountered.

FIG. 19 is an illustration showing a circuit construction in the vicinity of connecting portion 1901 of the chips 1101 and

1102 when a plurality of driver IC chips formed with the bidirectional scanning circuits. By adding the dummy bit DB1, the output timing of the output signal OUT121 is delayed for one clock period from the normal timing.

On the other hand, since no feedback circuit 110 is provided at the connecting portion 1901, attenuation of the signal is caused to make it impossible to transfer the normal scanning pulse signal subsequent to the OUT 121 (the first output OUT1 of the second chip 1102).

For the reason discussed above, the bidirectional scanning circuit shown in FIGS. 15 to 18 cannot be applied to the driver IC chip.

SUMMARY OF THE INVENTION

It is an object of the present invention to provide a high speed bidirectional scanning circuit applicable even when a plurality of IC chips are connected in cascade.

In order to accomplish the above-mentioned object, according to one aspect of the invention, a bidirectional scanning circuit comprises:

a plurality of switching means controlled to be turned ON and OFF by a clock signal and mutually connected in series;

a plurality of feedback means connected to respective series connecting points of respective of the switching means and being controlled activation by the clock signal, for preventing attenuation of amplitude of branched signals at respective series connecting points;

a plurality of buffer means for inputting outputs of the feedback means;

a plurality of logic gate means for inputting outputs of a (J)th (J is natural number) and (J+1)th buffer means;

first and second input/output terminals for inputting and outputting a start pulse for initiation of scanning;

assuming sequential K (K is an integer greater than or equal to 6) in number of series connecting points of the switching means being N(1) to N(K−1) from the ends and assuming that the terminals at both ends are N(0) and N(K), one direction shifting input means connected between the first input/output terminal and a terminal of N(L)th order (L is an integer of $0 \leqq L \leqq K-6$);

the other direction shifting output means connected between the first input/output terminal and a terminal of N(R)th order (R is an integer of $0 \leqq R \leqq K-6$);

the other direction shifting input means connected between the second input/output terminal and a terminal of (M)th order (M is an integer of $6 \leqq M \leqq K$);

one direction shifting output means connected between the second input/output terminal and a terminal of N(Q)th order (Q is an integer of $6 \leqq Q \leqq K$, $|L-Q|=|R-M|$); and a plurality of scanning output terminals leading out respective output pulses of the logic gate means of G(L+1) to G(M−2) as taking the logic gate means as G(1) to G(K−1) in sequential order from the end.

The switching means may be a transfer gate element controlled to turn ON and OFF by two phase signals as complementary signal of the clock signal.

According to another aspect of the invention, a bidirectional scanning circuit employing a plurality of bidirectional scanning circuits as defined above, with establishing a cascade connection by connecting the second input/output terminal of one scanning circuit with the first input/output terminal of other scanning circuit for inputting the start pulse from the first input/output terminal of the scanning circuit at the first stage or the second input/output terminal of the scanning circuit at the final stage.

In the construction set forth above, it is preferred that L, Q, R and M are selected to satisfy L=Q=R=M=2. The bidirectional scanning circuit is applicable for a liquid crystal display. In the preferred construction, each of the switching means, the feedback means, the buffer means and the logic gate means may be constructed by a thin film transistor element.

According to a further aspect of the invention, a bidirectional scanning circuit comprises:

a plurality of switching means controlled to be turned ON and OFF by a clock signal and mutually connected in series;

a plurality of feedback means connected to respective series connecting points of respective of the switching means and being controlled activation by the clock signal, for preventing attenuation of amplitude of branched signals at respective series connecting points;

a plurality of buffer means for inputting outputs of the feedback means;

first and second input/output terminals for inputting and outputting a start pulse for initiation of scanning;

assuming sequential K (K is an integer greater than or equal to 6) in number of series connecting points of the switching means being N(1) to N(K−1) from the ends and assuming that the terminals at both ends are N(0) and N(K), one direction shifting input means connected between the first input/output terminal and a terminal of N(L)th order (L is an integer of $0 \leqq L \leqq K-6$);

the other direction shifting output means connected between the first input/output terminal and a terminal of N(R)th order (R is an integer of $0 \leqq R \leqq K-6$);

the other direction shifting input means connected between the second input/output terminal and a terminal of N(M)th order (M is an integer of $6 \leqq M \leqq K$);

one direction shifting output means connected between the second input/output terminal and a terminal of N(Q)th order (Q is an integer of $6 \leqq Q \leqq K$, $|L-Q|=|R-M|$); and a plurality of scanning output terminals leading out respective output pulses of the buffer means of G(L+2) to G(M−2) as taking the buffer means as G(1) to G(K−1) in sequential order from the end.

According to a still further aspect, a bidirectional scanning circuit employing a plurality of bidirectional scanning circuits as defined above, with establishing a cascade connection by connecting the second input/output terminal of one scanning circuit with the first input/output terminal of other scanning circuit for inputting the start pulse from the first input/output terminal of the scanning circuit at the first stage or the second input/output terminal of the scanning circuit at the final stage.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings:

FIG. 1 is a circuit diagram of the first embodiment of a scanning circuit according to the present invention;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 15:
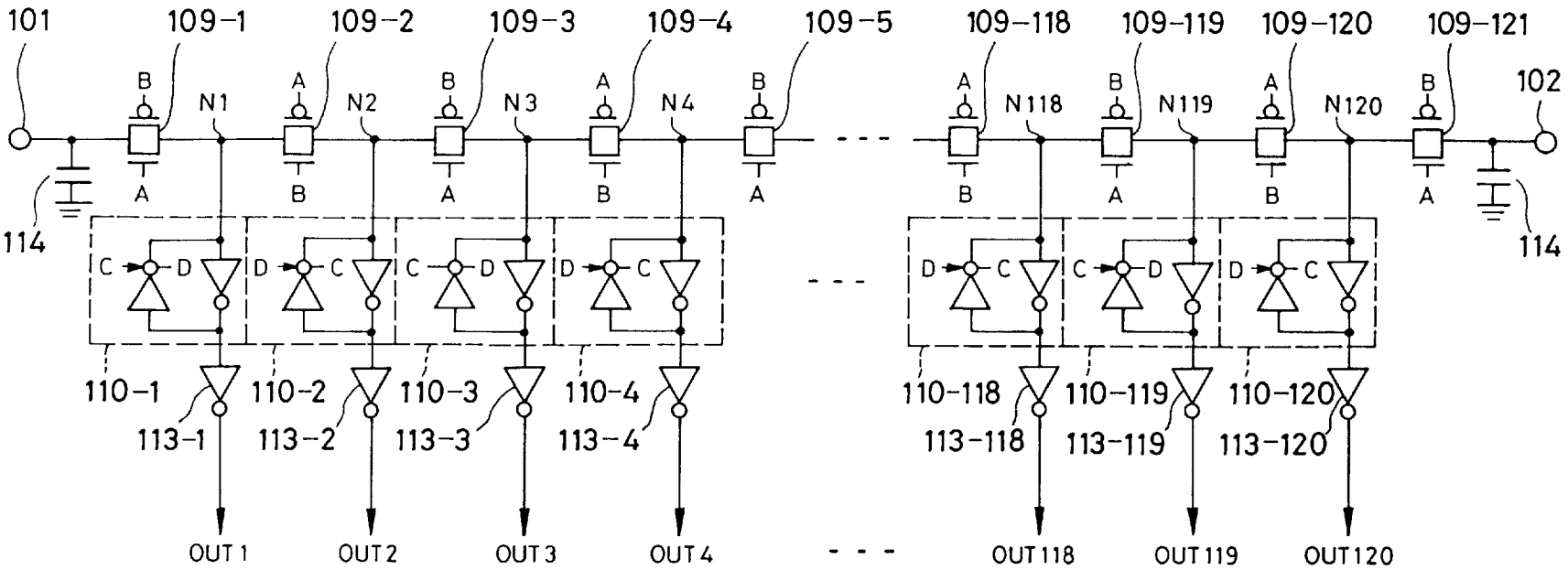
FIG.15 (PRIOR ART)
FIG. 15 is an illustration showing a construction of the conventional scanning circuit.
Figure 16:
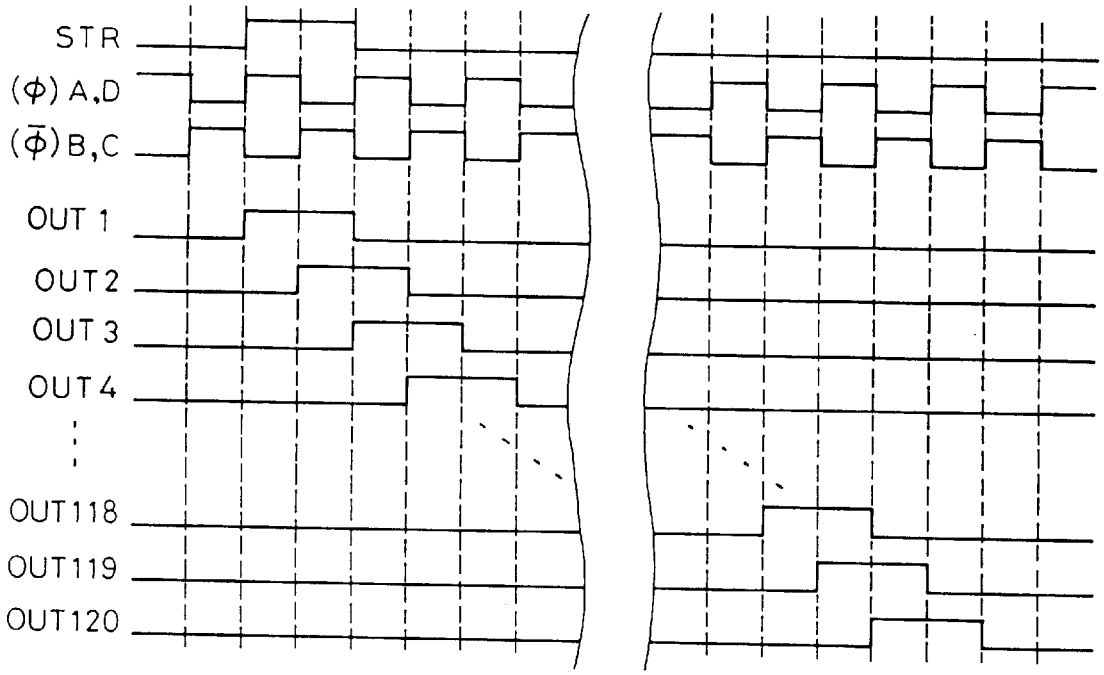
FIG.16 (PRIOR ART)
FIG. 16 is a timing chart of the conventional scanning circuit.
Figure 17:
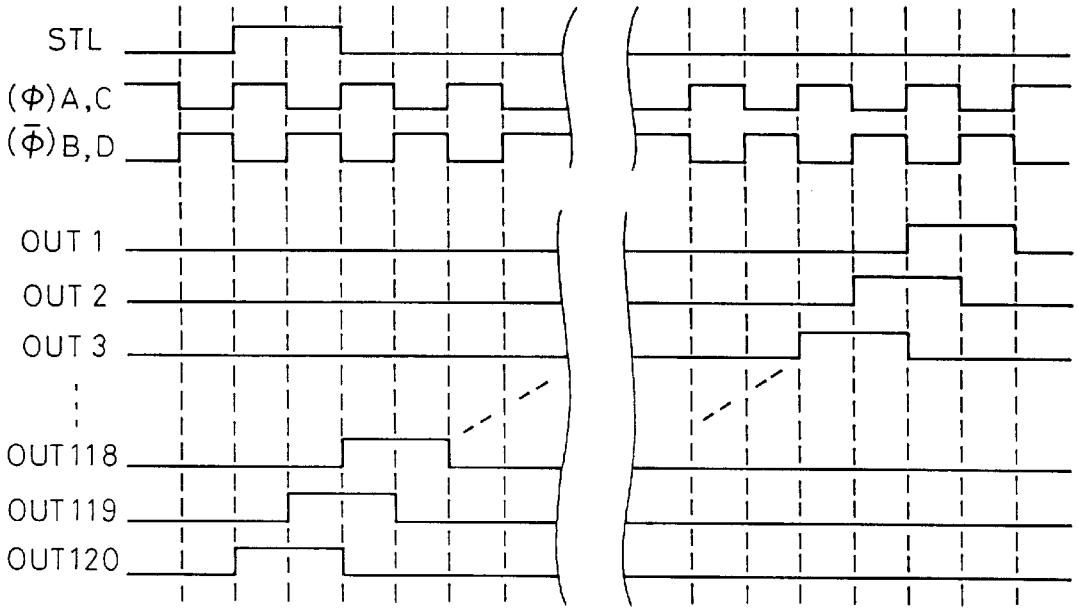
FIG.17 (PRIOR ART)
FIG. 17 is a timing chart of the conventional scanning circuit.
Figure 18:
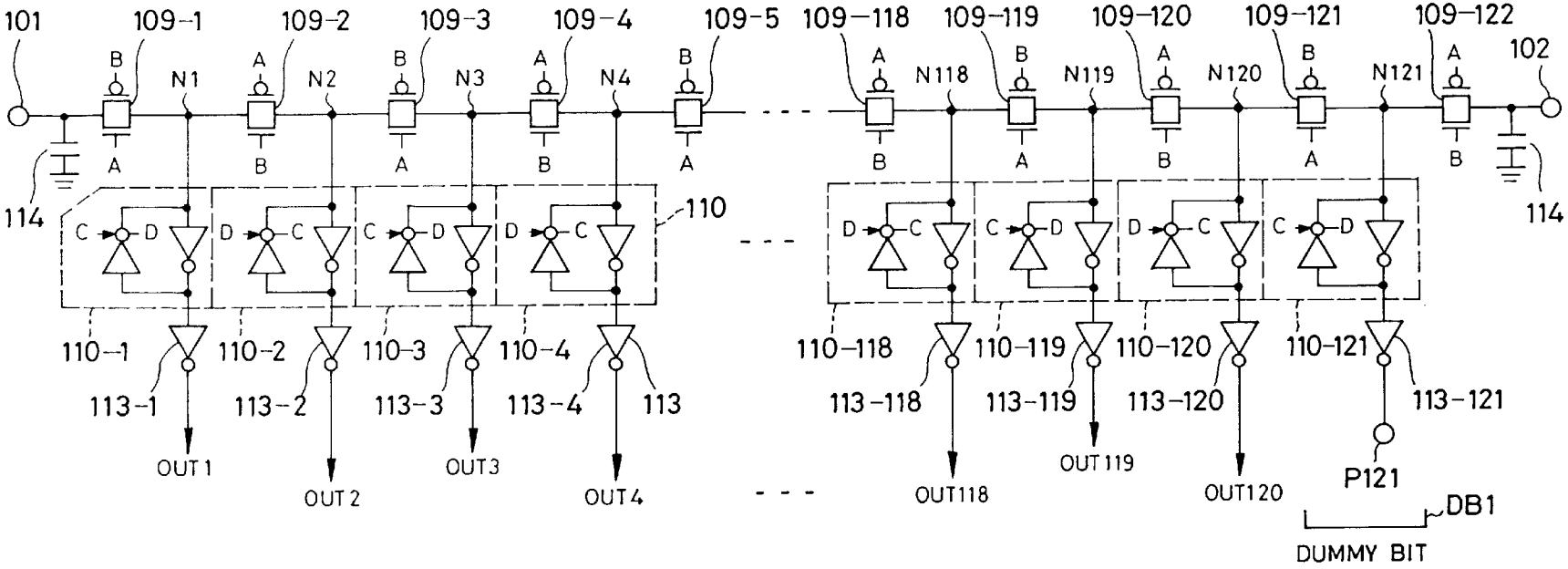
FIG.18 (PRIOR ART)
FIG. 18 is an illustration of another example of the conventional scanning circuit.
Figure 19:
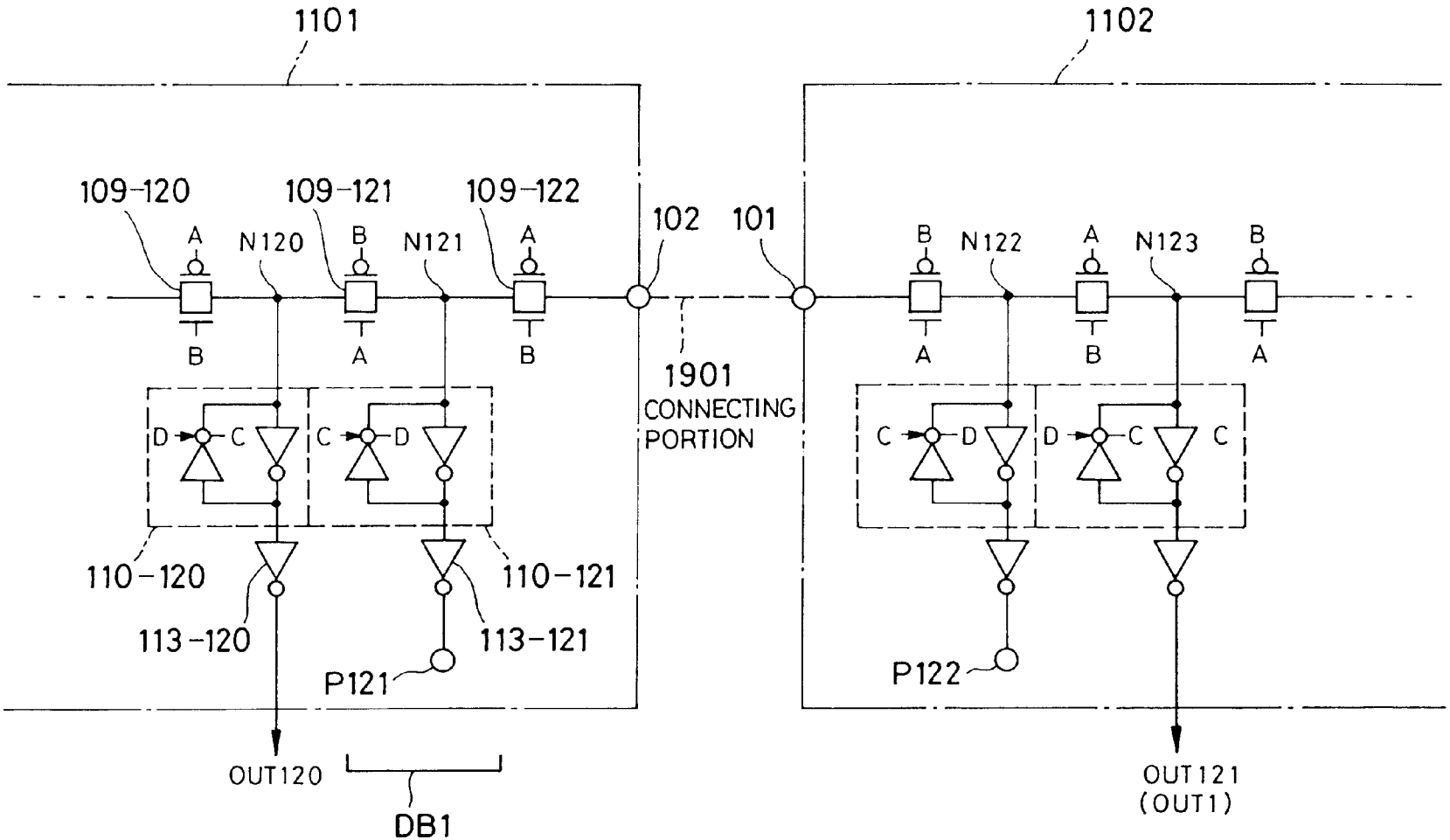
FIG.19 (PRIOR ART)
FIG. 19 is an illustration showing a circuit construction of a connecting portion of the conventional scanning circuit.

FIG. 1 is a circuit diagram showing the first embodiment of a scanning circuit according to the present invention. In FIG. 1, like elements to those in FIGS. 15 and 18 will be identified by like reference numerals, and redundant discussion for such common elements will be avoided for keeping the disclosure simple enough to facilitate clear understanding of the present invention. Even in the shown embodiment, there is shown an example, in which number of outputs of the scanning circuit is 120. On the other hand, as a transistor, p-SiTFT fabricated through a low temperature process, in which the maximum process temperature is lower than or equal to 600° C.

As shown in FIG. 1, the first embodiment of the scanning circuit according to the present invention is constructed with transfer gates 109-1 to 109-125 transferring a signal from a former stage to a later stage with delay depending upon the clock signals A and B, feedback circuits 110-1 to 110-124 preventing attenuation of amplitude of the pulse signal (a branched output signal of the transfer data) transferred with delay, buffer circuits 111-1 to 111-124, NAND circuits 112-1 to 112-124 (in the final stage, a circuit power source $V_{DD}$ is taken as one input)taking respective output signals of the buffer circuits 111-1 to 111-124 and respective output signals of the buffer circuits 111-2 to 111-124, output buffer circuits 113-1 to 113-124 outputting an output signal with taking the output signals of the NAND circuits 112-1 to 112-124 as input signals, rightward shifting input circuit 103 and the leftward shifting output circuit 105 controlling input and output of transfer signal upon bidirectional switching of shifting, and leftward shifting input circuit 104 and rightward shifting output circuit 106.

Each of these shifting input and output circuits is constructed with inverters I1 and I2, and a transfer gate T1 controlled ON and OFF by shifting direction switching signals L and R, as illustrated in the rightward shifting input circuit 103 as representative.

Figure 14A:
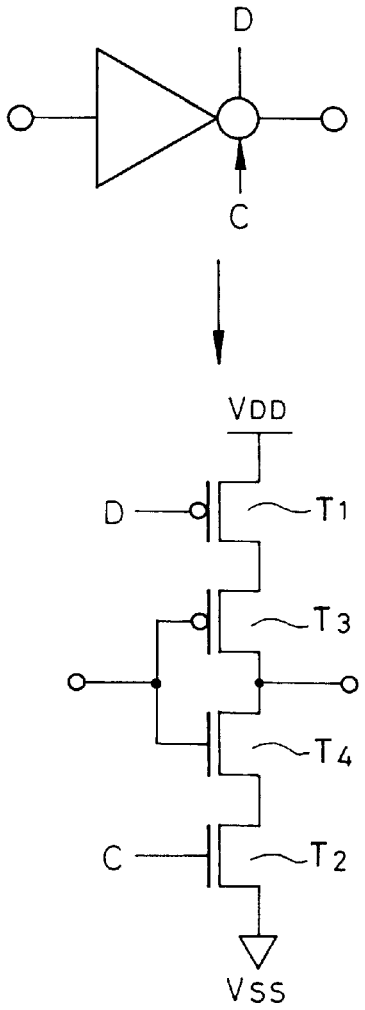
FIGS. 14A and 14B are illustration showing symbols and constructions of a clocked inverter circuit.
Figure 14B:
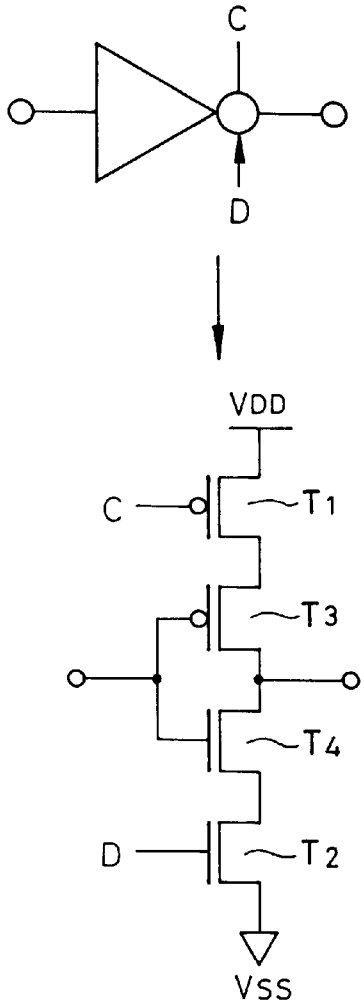

As shown in FIG. 1, each of the feedback circuits 110-1 to 110-124 is constructed with an inverter and a clocked inverter. The clocked inverter is controlled by the clock signals C and D. The detailed construction of the clocked inverter is as shown in FIG. 14.

On the other hand, in FIG. 1, N1 to N124 represent junctions between the transfer gates 109-1 to 109-124 and the next stage transfer gates 109-2 to 109-125.

As shown in FIG. 1, the first input/output terminal 101 is connected to respective junctions N2 and N4 via the rightward shifting input circuit 103 and the leftward shifting output circuit 105. The first input/output terminal 101 serves as a terminal for inputting a transfer signal upon performing scanning in the rightward shifting direction and serves as a terminal for outputting the transfer signal upon performing scanning in the leftward shifting direction.

On the other hand, the second input/output terminal 102 is connected to respective junctions N124 and N122 via the leftward shifting input circuit 104 and the rightward shifting output circuit 106.

The rightward shifting input circuit 103, the leftward shifting output circuit 105, the leftward shifting input circuit 104 and the rightward shifting output circuit 106 are controlled by shifting direction switching control signals R and L. Upon performing scanning in the rightward shifting direction, the control signal R is set at HIGH level and the control signal L is set at LOW level. On the other hand, upon scanning in the leftward shifting direction, the control signal R is set at LOW level and the control signal L is set at HIGH level.

By controlling the manner set forth above, upon scanning in the rightward shifting direction, the first input/output terminal 101 serves as the terminal for externally inputting the transfer signal, and, in conjunction therewith, the second input/output terminal 102 serves as the terminal for externally outputting the transfer signal. Conversely, upon scanning in the leftward shifting direction, the first input/output terminal 101 serves as the terminal for externally outputting the transfer signal and the second input/output terminal 102 serves as the terminal for externally inputting the transfer signal.

In the shown embodiment, each of the rightward shifting input circuit 103, the leftward shifting output circuit 105, the leftward shifting input circuit 104 and the rightward shifting output circuit 106 is constructed with two stages of inverters I1 and I2 and the transfer gate T1 controlled by the control signals R and L. However, the shifting input circuits and the shifting output circuits may be constructed with other circuit construction as long as the same functions can be achieved. Also, it is possible to replace the NAND circuits 112-1 to 112-124 with other logic gate circuits.

On the other hand, the input/output terminal of the transfer gates at both ends are in open condition, which are respectively illustrated as a first open terminal 107 and a second open terminal 108. As set forth with respect to the prior art, floating capacitors 114 greater than the capacitance of the transistor are normally provided for these open terminals. Such floating capacitance can be a cause of malfunction. However, in the scanning circuit according to the present invention, respective dummy bits DB11 to DB14 are provided for two bits at both ends as shown so that malfunction signal may not appear in the output signals OUT1 to OUT120 of the scanning circuit.

Figure 2:
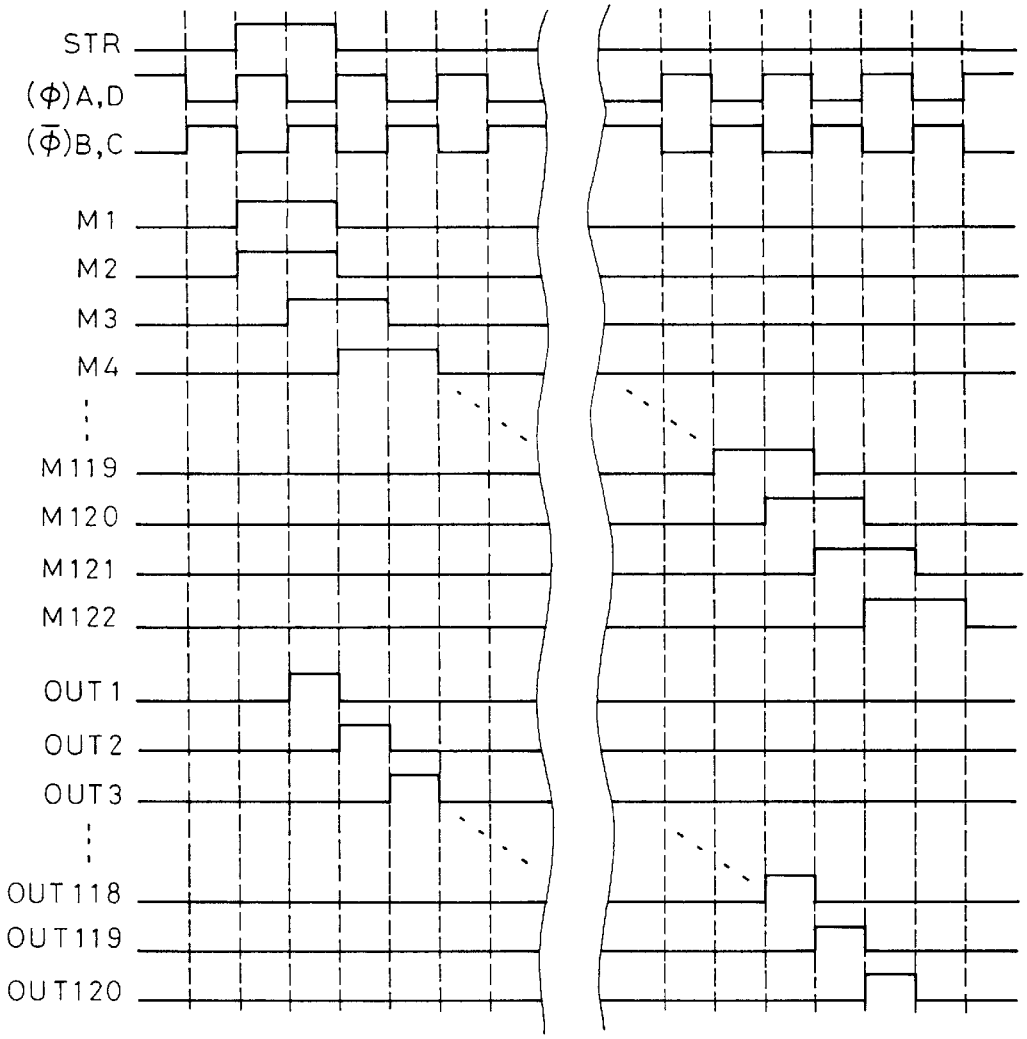
FIG. 2 is a timing chart showing the operation of the first embodiment of the scanning circuit according to the present invention.

The operation of the shown embodiment of the scanning circuit according to the present invention, as set forth above will be discussed with reference to FIGS. 2 and 3. FIG. 2 is a timing chart showing the operation of the scanning circuit upon rightward shifting. In case of the rightward shifting, a start pulse STR is input to the first input/output terminal 101 at a timing shown in the drawing under the condition where the shifting direction switching control signal R is set at HIGH level and the control signal L is set at LOW level. On the other hand, the clock signals A and D are taken as a common clock signal $\phi$, and the clock signals B and C are taken as a common clock signal for $\bar{\phi}$ which has a complementary phase with reference to the clock signal $\phi$.

On the other hand, by inputting such signal, as the input signal of the NAND circuit, pulse signals M2 to M122 shifting in sequential order of M2, M3, M4, . . . M122 are generated in the shown timings. As a result, output signals OUT1 to OUT120 having pulse widths corresponding to half of a clock period and shifted for half period of the clock in sequential order are output. At this time, the same pulse signal as input signal M121 of the NAND circuits 112–122 is output from the second input/output terminal 102 through the rightward shifting output circuit 106.

Figure 3:
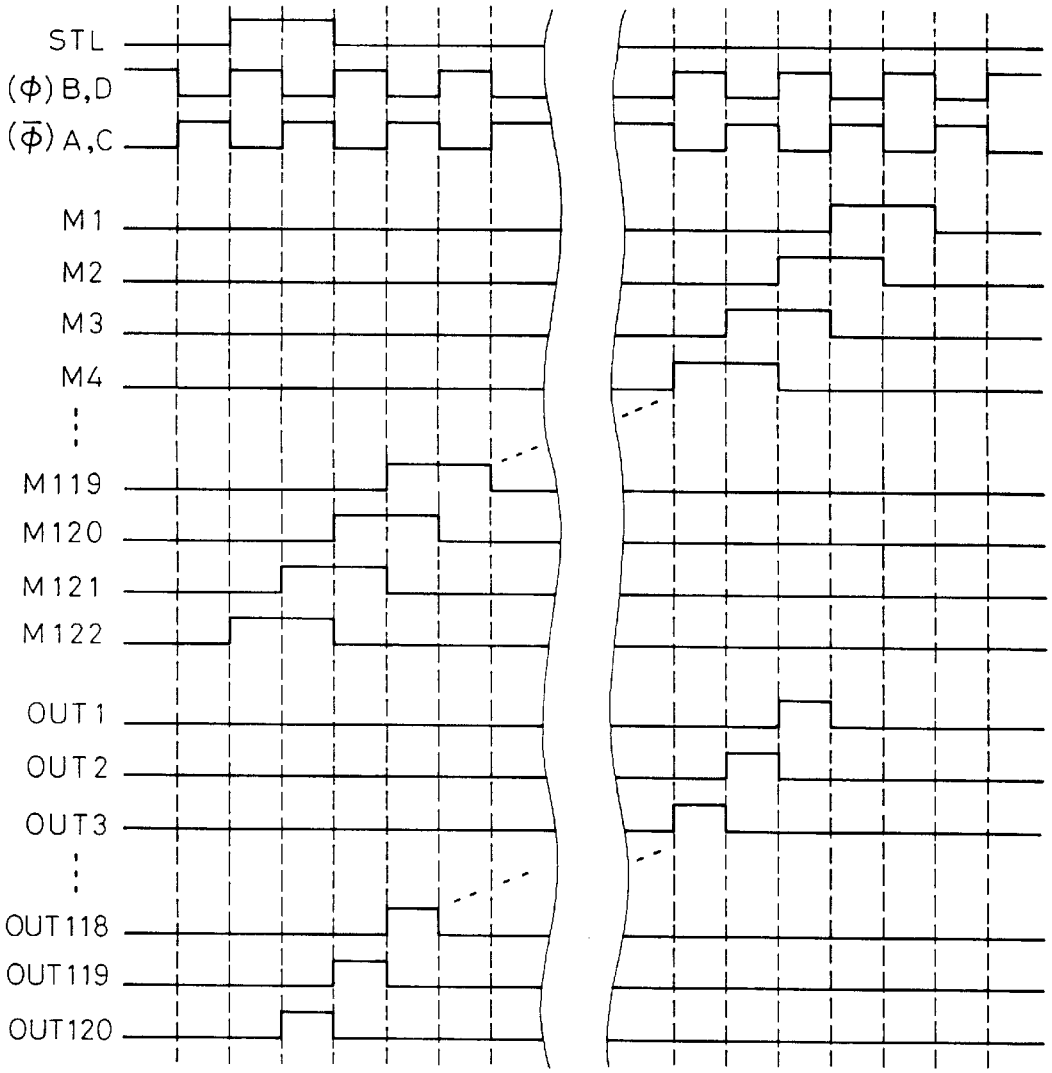
FIG. 3 is a timing chart showing the operation of the first embodiment of the scanning circuit according to the present invention.

On the other hand, FIG. 3 shows a timing chart in the case of leftward shifting. The start pulse STL is input to the second input/output terminal 102 at the shown timing under the condition where the shifting direction switching control signal R is set at LOW level and the control signal L is set at HIGH level. On the other hand, the clock signals B and D are taken as a common clock signal $\phi$, and the clock signals A and C are taken as a common clock signal for $\bar{\phi}$ which has a complementary phase with reference to the clock signal $\phi$.

By inputting such signal, as the input signal of the NAND circuit, pulse signals M122 to M1 shifting in sequential order of M122, M121, M120, . . . M1 are generated in the shown timings. As a result, output signals OUT120 to OUT1 having pulse widths corresponding to half of a clock period and shifted for half period of the clock in sequential order are output. At this time, the same pulse signal as input signal M3 of the NAND circuits 112-4 is output from the first input/output terminal 101 through the leftward shifting output circuit 105.

Figure 10:
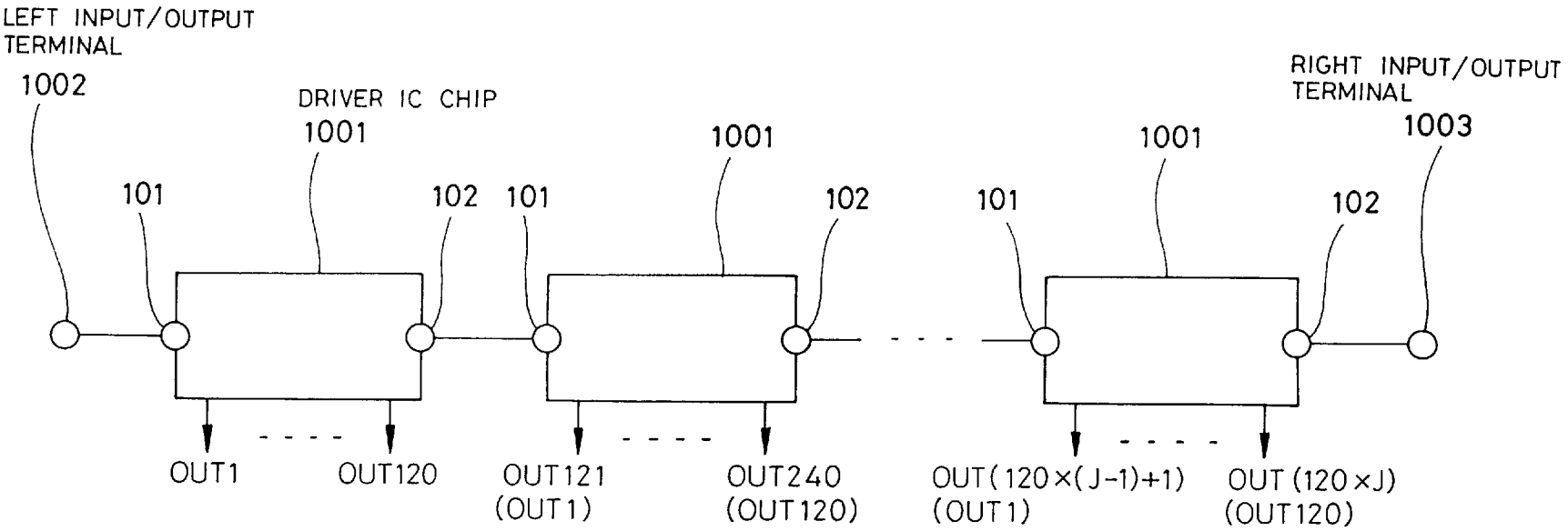
FIG. 10 is block diagram of a driver IC chip, in which a plurality of the scanning circuits are connected.

Next, discussion will be given for the case where the scanning circuit according to the present invention is applied on the driver IC chip and a plurality of the scanning circuits are connected. FIG. 10 is a block diagram, in which the scanning circuit of 120 bits as shown in FIG. 1 is applied on the driver IC chip 1001, and J in number of the scanning circuits are connected.

At this time, a left input/output terminal 1002 is connected to the first input/output terminal 101 of the first scanning circuit, and the right input/output terminal 1003 is connected to the second input/output terminal 102 of the (J)th scanning circuit. On the other hand, the second input/output terminal of the (K)th (K is a natural number less than or equal to (J−1)) is connected to the first input/output terminal 101 of the (K+1)th scanning circuit. Thus, when J in number of the driver IC chips, each is constructed with individual scanning circuits, are connected to form one scanning circuit, OUT(1) to OUT(120×J) are obtained as outputs of the scanning circuit.

Figure 11:
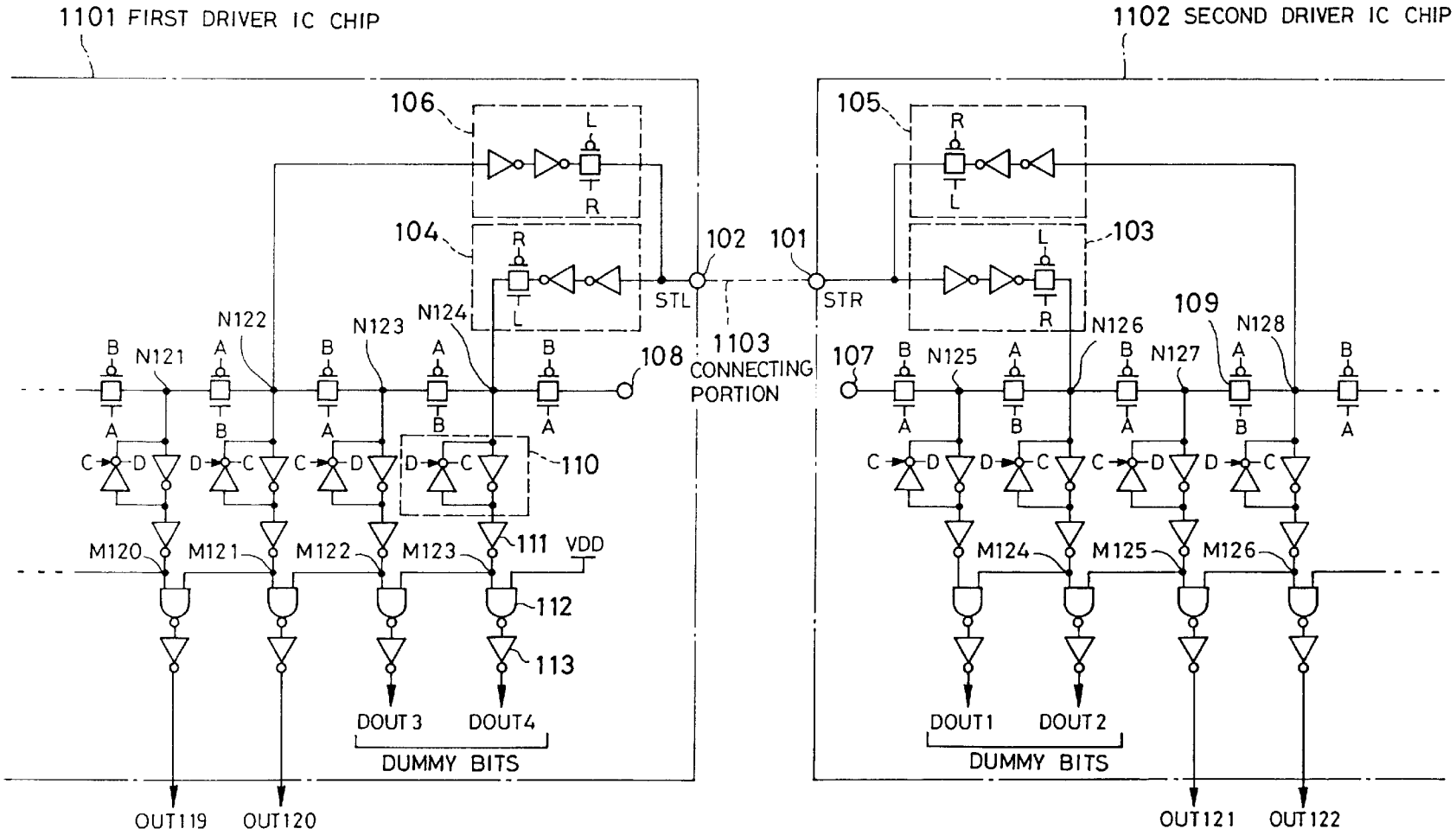
FIG. 11 is a circuit diagram of the fifth embodiment of the scanning circuit according to the present invention.

On the other hand, FIG. 11 is an illustration showing a circuit construction in the vicinity of the junction between the first driver IC chip 1101 and the second driver IC chip 1102 when a plurality of driver IC chips, each consisted of the bidirectional scanning circuit shown in FIG. 1. As shown in FIG. 11, connection of the chips is established by connecting the second input/output terminal 102 of the first driver IC chip 1101 and the first input/output terminal 101 of the second driver IC chip 1102. The operation of the scanning circuit connected as set forth above will be discussed hereinafter.

Figure 12:
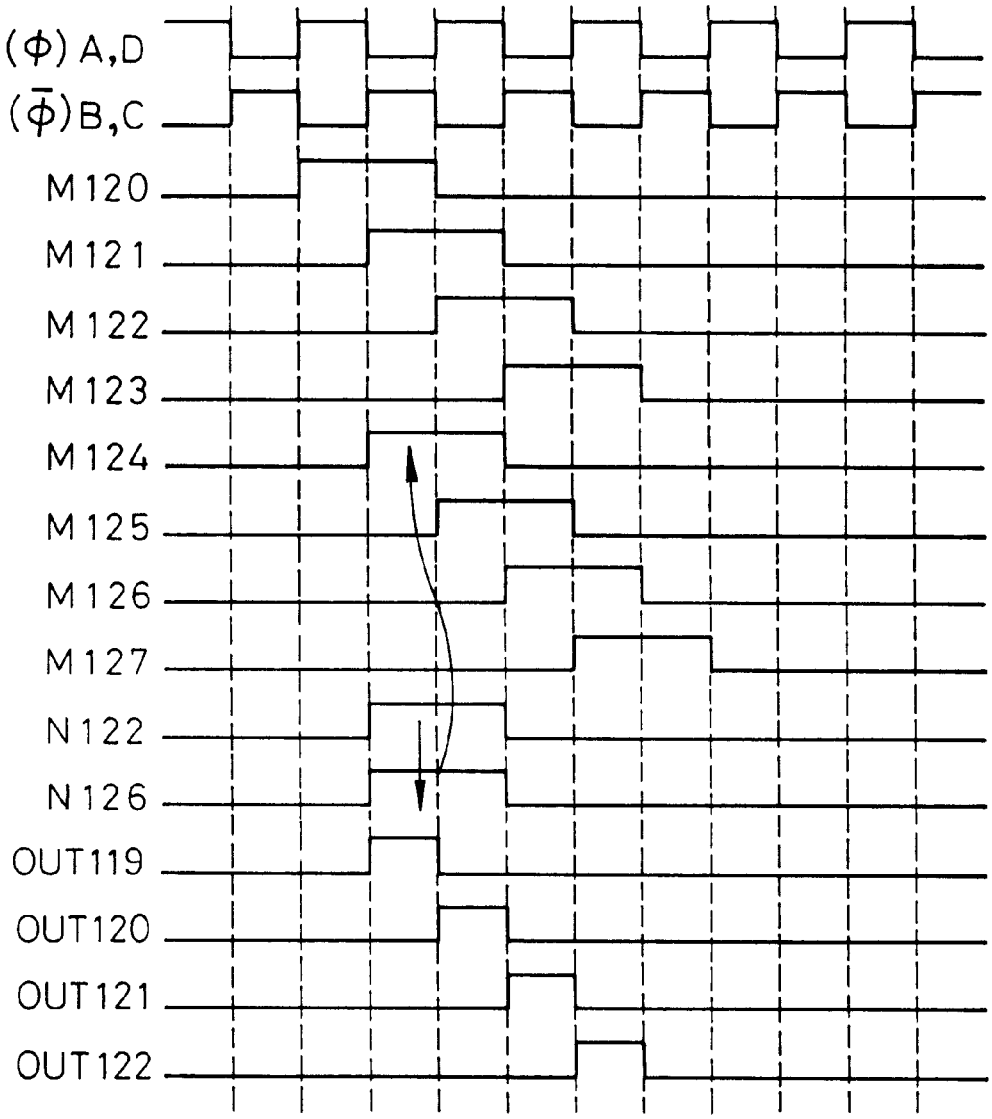
FIG. 12 is a timing chart of the scanning circuit according to the present invention.

FIG. 12 is a timing chart showing the operation of the scanning circuit upon rightward shifting. In FIG. 12, M120 to M127 and N122 and N126 represent respective node names shown in FIG. 11 and signal names at respective nodes.

In case of the rightward shifting, as set forth above, the clock signals A and D are taken as a common clock signal $\phi$, and the clock signals B and C are taken as a common clock signal for $\bar{\phi}$. Considering the case where the pulse signal having a pulse width equal to the clock period is transferred, the pulse signals M120 to M123 shifted in sequential order of M120, M121, M122, M123 are generated at a timing as shown in FIG. 12.

At this time, the pulse signal N122 same as the pulse signal M121 is output to the second input/output terminal 102 of the first driver IC chip through the rightward shifting output circuit 106. The pulse signal output to the second input/output terminal 102 is input to the first input/output terminal 101 of the second driver IC chip 1102 through the junction 1103. The pulse signal input to the first input/output terminal 101 is input to the junction N126 through the rightward shifting input circuit 103 of the second driver IC chip.

The pulse signal of the junction N122 is input to the junction N126 as set forth above, the pulse signals shifted in the sequential order of M124, M125, M126, . . . as the input signal of the NAND circuit 112 forming the second driver IC chip 1102 are generated at the shown timings. As a result, the scanning pulse signals shifted for half clock period in sequential order of OUT119, OUT120, OUT121 and OUT122, are generated in the shown timing.

Figure 13:
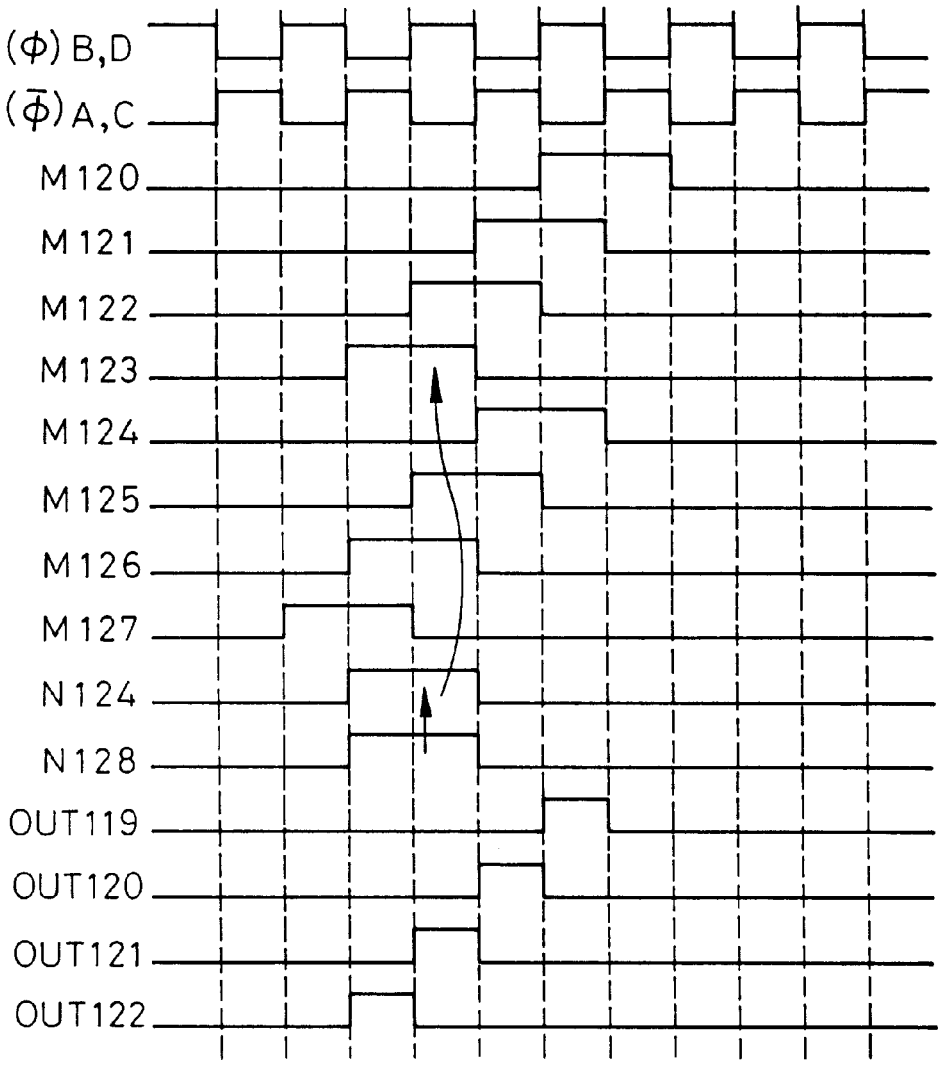
FIG. 13 is a timing chart of the scanning circuit according to the present invention.

On the other hand, FIG. 13 is a timing chart in the case where scanning in the leftward shifting direction is performed in the circuit shown in FIG. 11. As shown, M120 to M127 and N124 and N128 represent respective node names and, in conjunction therewith, represent signal names at respective nodes.

In case of the leftward shifting, as set forth above, the clock signals B and D are taken as a common clock signal $\phi$, and the clock signals A and C are taken as a common clock signal $\bar{\phi}$. Considering the case where the pulse signal having a pulse width equal to the clock period is transferred, the pulse signals M127 to M124 shifted in sequential order of M127, M126, M125, M124 are generated at a timming as shown in FIG. 13.

At this time, the pulse signal N128 same as the pulse signal M126 is output to the first input/output terminal 101 of the second driver IC chip 1102 through the leftward shifting output circuit 105. The pulse signal output to the first input/output terminal 101 is input to the second input/output terminal 102 of the first driver IC chip 1101 through the junction 1103. The pulse signal input to the second input/output terminal 102 is input to the junction N124 through the leftward shifting input circuit 104 of the first driver IC chip.

The pulse signal of the junction N128 is input to the junction N124 as set forth above, the pulse signals shifted in the sequential order of M123, M122, M121, . . . as the input signal of the NAND circuit 112 forming the first driver IC chip 1101 are generated at the shown timings. As a result, the scanning pulse signals shifted for half clock period in sequential order of OUT122, OUT121, OUT120 and OUT119, are generated in the shown timing.

As set forth above, by employing the scanning circuit according to the present invention, it becomes possible to make the malfunction of the final bit not appearing in the output. In case where the a plurality of the driver IC chips are connected, the scanning pulse signal having not timing error can be taken out. Accordingly, the driver IC chip consisted of high speed bidirectional scanning circuit can be fabricated.

In the shown embodiment, while the p-SiTFT fabricated through the low temperature process is employed as the transistor, it is also possible to employ the p-SiTFT fabricated through a high temperature process with maximum process temperature of 1000° C. On the other hand, other thin film transistor, such as amorphous silicon (a-Si) TFT, a cadmium-selenium (CdSe) TFT and so forth may be employed. Also, a single crystalline silicon MOS transistor may be employed.

On the other hand, while the driver IC consisted only by the scanning circuits are illustrated in the shown embodiment, the present invention is applicable for circuits, in which a sample/hold circuit, an analog amplifier, a latch circuit, a digital to analog converter or so forth is added to the scanning circuit of the invention.

Figure 4:
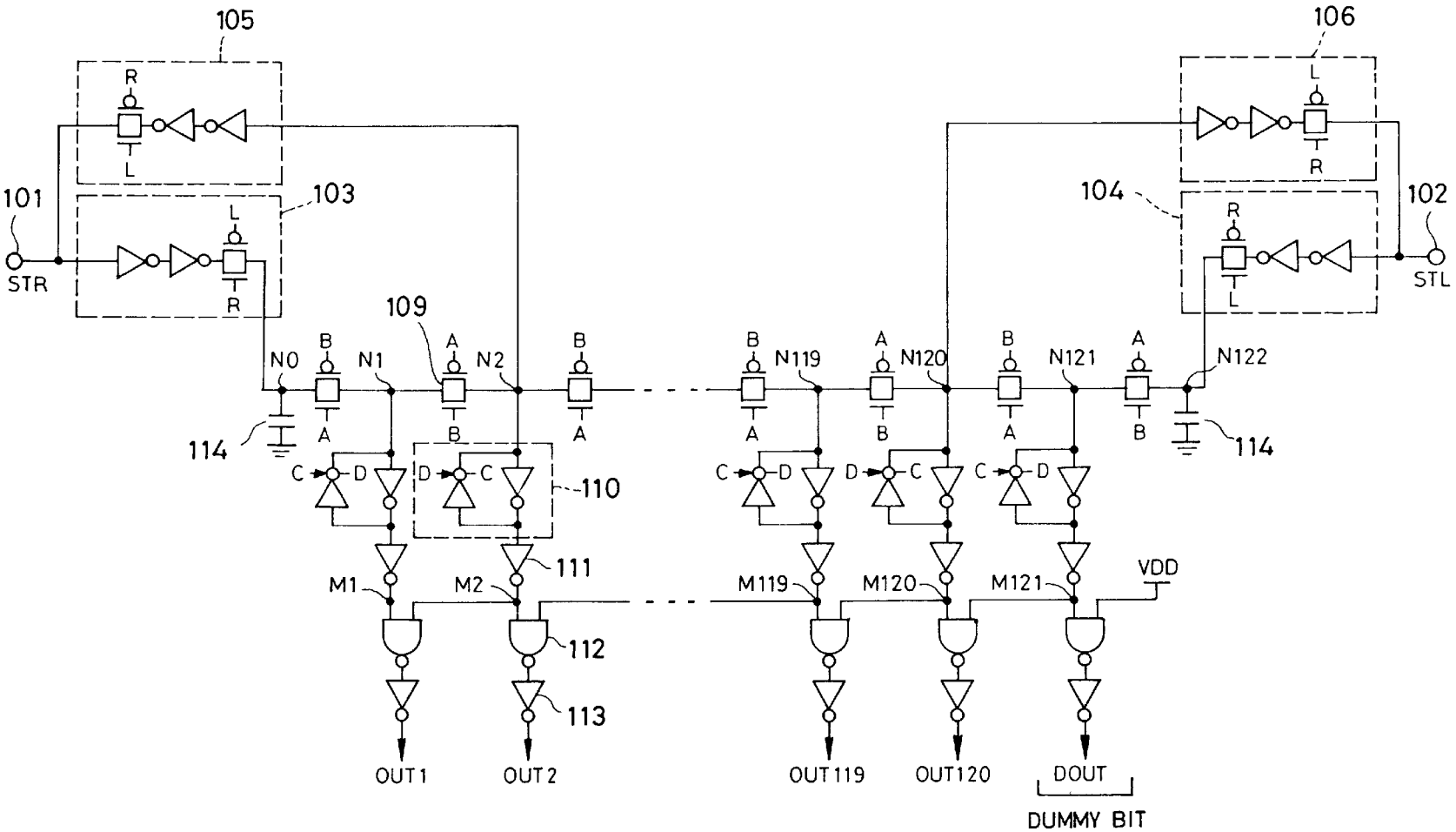
FIG. 4 is a circuit diagram of the second embodiment of a scanning circuit according to the present invention.

Next, the second embodiment of the scanning circuit according to the present invention will be discussed hereinafter in detail with reference to the drawings. FIG. 4 is a circuit diagram showing the second embodiment of the scanning circuit. In the shown embodiment, there is shown the case where number of outputs of the scanning circuit is 120. It should be noted that the reference numerals for the transfer gate, the feedback circuit, the buffer circuit, the NAND circuit, the output buffer circuit are given for only one of those elements as representative. Basically, these elements are similar to those of FIG. 1. On the other hand, the p-SiTFT fabricated through the low temperature process of lower than or equal to 600° C. at the maximum process temperature, as a transistor.

As shown, in the shown embodiment of the scanning circuit, the circuit construction of the circuit for transferring the pulse signal, the rightward shifting input circuit 103, the leftward shifting output circuit 105, the rightward shifting output circuit 106 and the leftward shifting input circuit 104 are identical to those of the first embodiment. There is a difference in a node, to which the first input/output terminal is connected respectively through the right shifting input circuit 103 and the left shifting output circuit 105, and a node, to which the second input/output terminal is connected respectively through the rightward shifting output circuit 106 and the leftward shifting input circuit 104.

In FIG. 4, N0 to N122 and M1 to M121 represent respective node names, and in conjunction therewith, represent signals at respective nodes. At this time, the first input/output terminal 101 is connected to junctions N0 and N2 respectively through the rightward shifting input circuit 103 and the leftward shifting output circuit 105. On the other hand, the second input/output terminal 102 is connected to respective junctions N122 and N120 through the leftward shifting input circuit 104 and the rightward shifting output circuit 106.

Similarly to the first embodiment, the rightward shifting input circuit 103, the leftward shifting output circuit 105, the leftward shifting input circuit 104 and the rightward shifting output circuit 106 are controlled by the shifting direction switching control signals R and L. Upon performing scanning in the rightward direction, the control signal R is set at HIGH level and the control signal L is set at LOW level. Conversely, upon performing scanning in the leftward direction, the control signal R is set at LOW level and the control signal L is set at HIGH level.

By controlling in such a manner, upon scanning in the rightward shifting direction, the first input/output terminal serves as a terminal for externally inputting the transfer signal, and the second input/output terminal serves as a terminal for externally outputting the transfer signal. Upon scanning in the leftward shifting direction, the first input/output terminal serves as a terminal for externally outputting the transfer signal and the second input/output terminal serves as a terminal for externally inputting the transfer signal.

In the shown embodiment, each of the rightward shifting input circuit 103, the leftward shifting output circuit 105, the leftward shifting input circuit 104 and the rightward shifting output circuit 106 is constructed with two stage inverter circuits and a transfer gate controlled by the control signals R and L. However, it may be possible to construct the shifting circuit with any other circuit construction as long as it performs the same function. Also, it is possible to employ other logic gate circuit in place of the NAND circuit 112.

On the other hand, to the junctions N0 and N122, the floating capacitors 114 to be a case of malfunction of the final bit, are added as discussed with respect to the prior art. The floating capacitors 114 are separated from the external terminal by the rightward shifting input circuit 103 and the leftward shifting input circuit 104, respectively. Therefore, capacitance of the floating capacitors 114 are smaller than or equal to the gate capacitance of the transistor constructing the circuit. Accordingly, in the shown embodiment of the scanning circuit, malfunction of the final bit may not be caused by the floating capacitors of the junctions N0 and N122.

The operation of the scanning circuit according to the present invention, as set forth above will be discussed hereinafter with reference to FIGS. 5 and 6. In case of rightward shifting, the start pulse STR is input to the first input/output terminal 101 at the shown timing with setting the shifting direction switching control signal R at HIGH level and the control signal L at LOW level. On the other hand, the clock signals A and D are taken as a common clock signal $\phi$, and the clock signals B and C are taken as a common clock signal for $\bar{\phi}$.

By inputting such signal, as input signal of the NAND circuit 112, pulse signals M1 to M121 shifted in the sequential order of M1, M2, M3, . . . M121, are generated at the shown timing. As a result, output signals OUT1 to OUT120 having a pulse width of half of the clock period and shifted for half clock period in sequential order, are output. At this time, the pulse signal same as the input signal M120 of the NAND circuit 112 is output from the second input/output terminal 102 through the rightward shifting output circuit 106.

Figure 6:
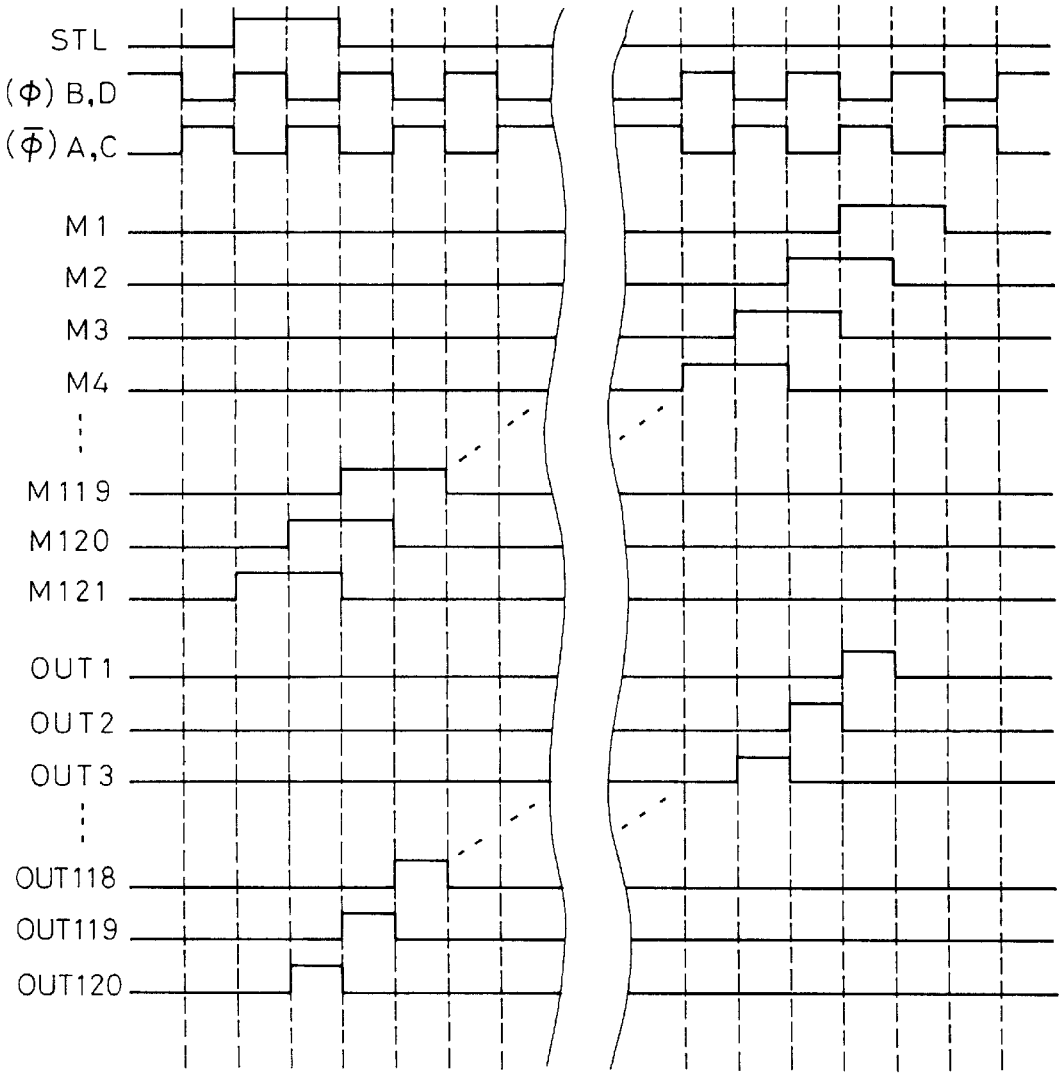
FIG. 6 is a timing chart showing the operation of the second embodiment of the scanning circuit according to the present invention.

On the other hand, FIG. 6 is a timing chart showing in the case of the leftward shifting in the shown embodiment of the scanning circuit according to the present invention. In case of the leftward shifting, the start pulse STR is input to the second input/output terminal 102 at the shown timing under the condition where the shifting direction switching control signal R is LOW level and the control signal L is HIGH level. On the other hand, the clock signals B and D are taken as a common clock signal $\phi$, and the clock signals A and C are taken as a common clock signal for $\bar{\phi}$.

By inputting such signal, as input signal of the NAND circuit 112, pulse signals M121 to M1 shifted in the sequential order of M121, M120, M119, . . . M1, are generated at the shown timing. As a result, output signals OUT120 to OUT1 having a pulse width of half of the clock period and shifted for half clock period in sequential order, are output. At this time, the pulse signal same as the input signal M2 of the NAND circuit 112 is output from the first input/output terminal 101 through the leftward shifting output circuit 105.

Figure 5:
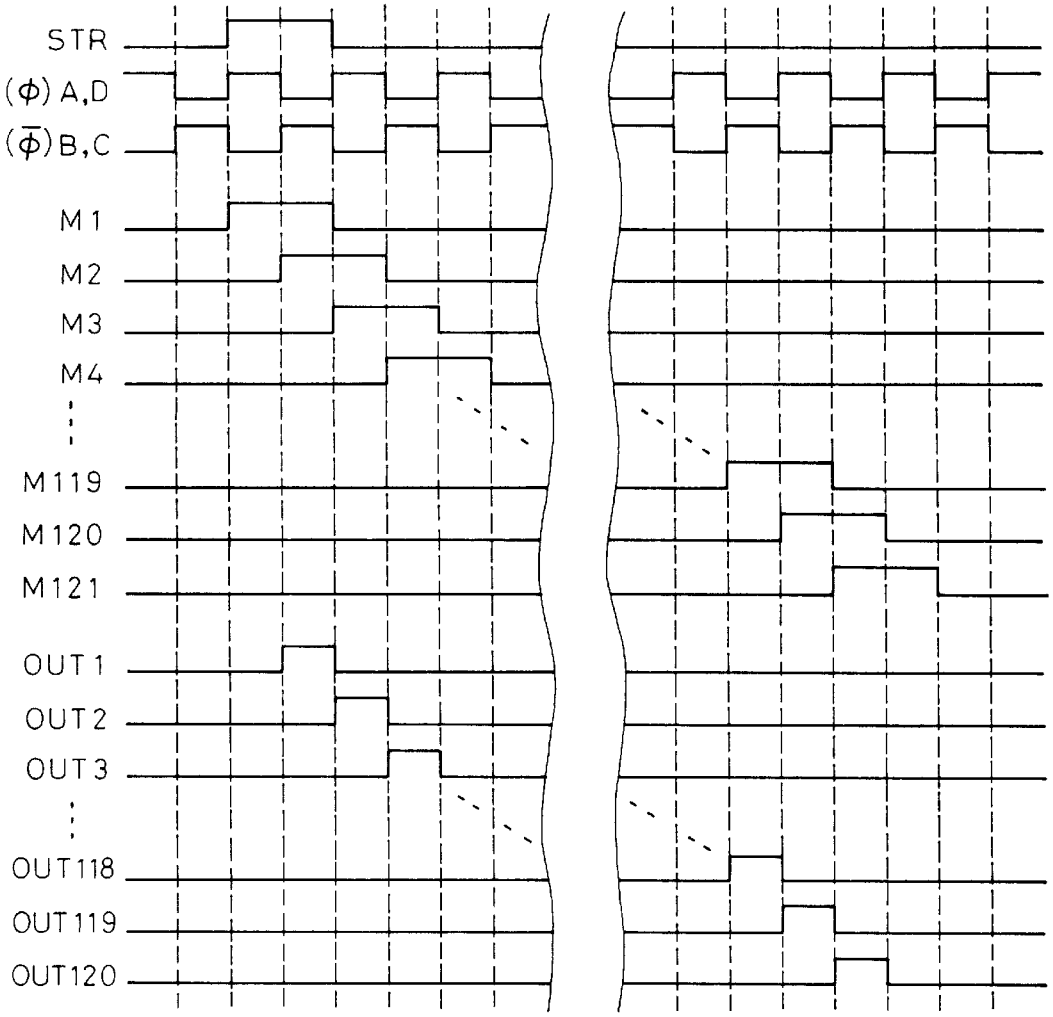
FIG. 5 is a timing chart showing the operation of the second embodiment of the scanning circuit according to the present invention.

On the other hand, it should be easily expected from the timing charts in FIGS. 5 and 6 that even in the case where the shown embodiment of a plurality of the scanning circuits are connected as application of the driver IC chip, the scanning pulse signal having no timing error can be lead out at the chip connecting portion similarly to the first embodiment.

In the shown embodiment, while the p-SiTFT fabricated through the low temperature process is employed as the transistor, it is also possible to employ the p-SiTFT fabricated through a high temperature process with maximum process temperature of 1000° C. On the other hand, other thin film transistor, such as amorphous silicon (a-Si) TFT, a cadmium-selenium (CdSe) TFT and so forth may be employed. Also, a single crystalline silicon MOS transistor may be employed.

On the other hand, while the driver IC consisted only by the scanning circuits are illustrated in the shown embodiment, the present invention is applicable for circuits, in which a sample/hold circuit, an analog amplifier, a latch circuit, a digital to analog converter or so forth is added to the scanning circuit of the invention.

Figure 7:
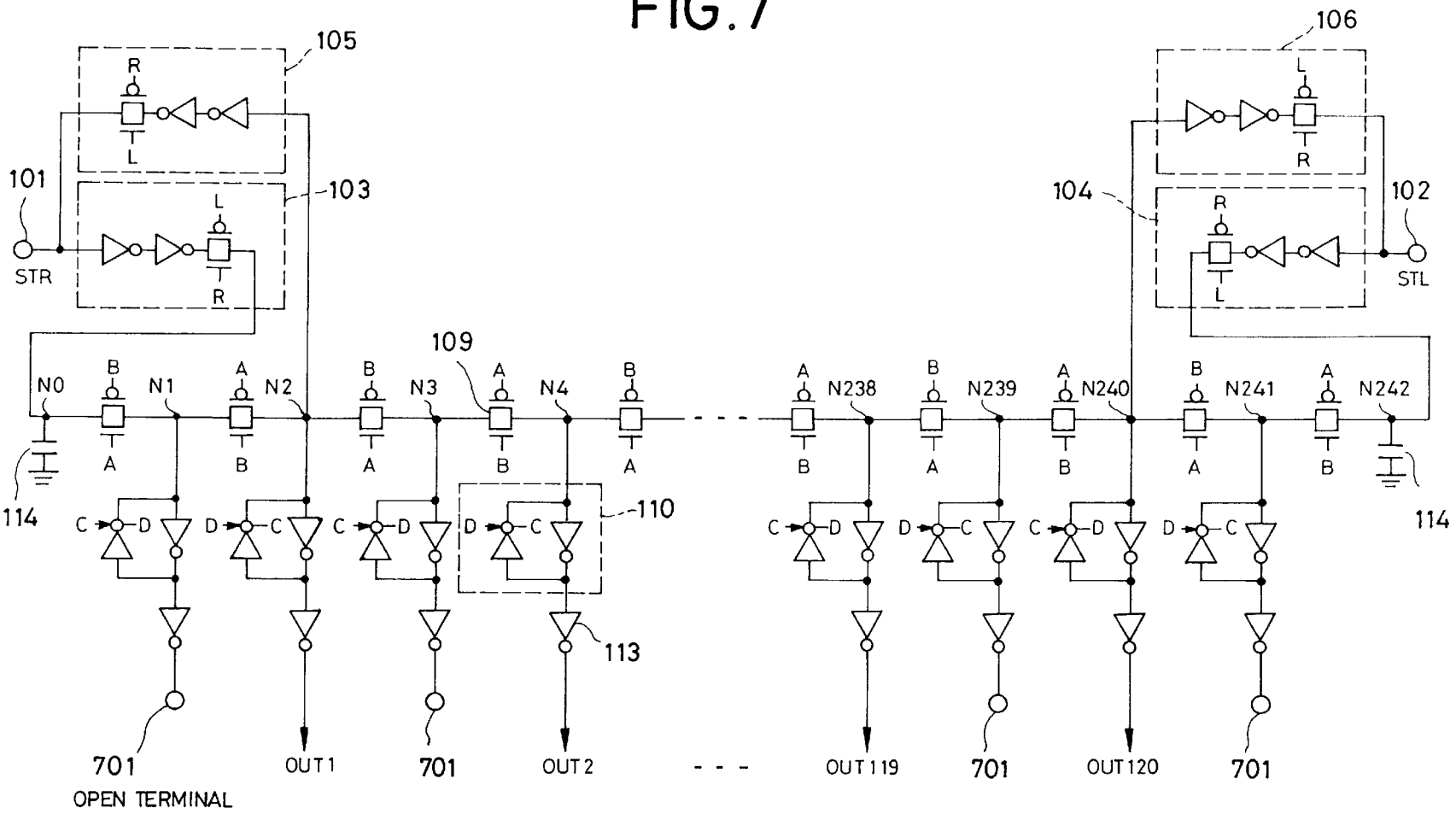
FIG. 7 is a circuit diagram of the third embodiment of a scanning circuit according to the present invention.

Next, the third embodiment of the scanning circuit according to the present invention will be discussed hereinafter in detail with reference to the drawings. FIG. 7 is a circuit diagram showing the third embodiment of the scanning circuit. In the shown embodiment, there is shown the case where number of outputs of the scanning circuit is 120. On the other hand, the p-SiTFT fabricated through the low temperature process of lower than or equal to 600° C. at the maximum process temperature, as a transistor.

As shown, in the shown embodiment of the scanning circuit, the rightward shifting input circuit 103, the leftward shifting output circuit 105, the rightward shifting output circuit 106 and the leftward shifting input circuit 104 are identical to those of the first embodiment. There is a difference from the first embodiment in a node, to which the first input/output terminal is connected respectively through the right shifting input circuit 103 and the left shifting output circuit 105, and a node, to which the second input/output terminal is connected respectively through the rightward shifting output circuit 106 and the leftward shifting input circuit 104. On the other hand, a pulse transfer portion is constructed with a transfer gate 109, a feedback circuit 110, an output buffer circuit 113 similarly to the construction of the conventional circuit shown in FIG. 15. In FIG. 7, N0 to N242 respectively represent node names.

At this time, the first input/output terminal 101 is connected to junctions N0 and N2 respectively through the rightward shifting input circuit 103 and the leftward shifting output circuit 105. On the other hand, the second input/output terminal 102 is connected to respective junctions N242 and N240 through the leftward shifting input circuit 104 and the rightward shifting output circuit 106.

Similarly to the first and second embodiments, the rightward shifting input circuit 103, the leftward shifting output circuit 105, the leftward shifting input circuit 104 and the rightward shifting output circuit 106 are controlled by the shifting direction switching control signals R and L. Upon performing scanning in the rightward direction, the control signal R is set at HIGH level and the control signal L is set at LOW level. Conversely, upon performing scanning in the leftward direction, the control signal R is set at LOW level and the control signal L is set at HIGH level.

By controlling in such a manner, upon scanning in the rightward shifting direction, the first input/output terminal serves as a terminal for externally inputting the transfer signal, and the second input/output terminal serves as a terminal for externally outputting the transfer signal. Upon scanning in the leftward shifting direction, the first input/output terminal serves as a terminal for externally outputting the transfer signal and the second input/output terminal serves as a terminal for externally inputting the transfer signal.

In the shown embodiment, each of the rightward shifting input circuit 103, the leftward shifting output circuit 105, the leftward shifting input circuit 104 and the rightward shifting output circuit 106 is constructed with two stage inverter circuits and a transfer gate controlled by the control signals R and L. However, it may be possible to construct the shifting circuit with any other circuit construction as long as it performs the same function.

On the other hand, utilizing even number terminals of OUT1 to OUT120 from the left in the drawing, the terminal 701 in the odd number is set as an open terminal. As can be clear from the discussion for operation described later using the timing chart of FIGS. 8 and 9, the scanning pulses are obtained to be shifted for one clock period from OUT1 to OUT120 in sequential order, by the reason why the NAND gate 112 is not provided.

On the other hand, to the junctions N0 and N242, the floating capacitors 114 to be a cause of malfunction of the final bit, is added as discussed with respect to the prior art. The floating capacitors 114 are separated from the external terminal by the rightward shifting input circuit 103 and the leftward shifting input circuit 104, respectively. Therefore, capacitance of the floating capacitors 114 are smaller than or equal to the gate capacitance of the transistor constructing the circuit. Accordingly, in the shown embodiment of the scanning circuit, malfunction of the final bit may not be caused by the floating capacitors of the junctions N0 and N242.

Figure 8:
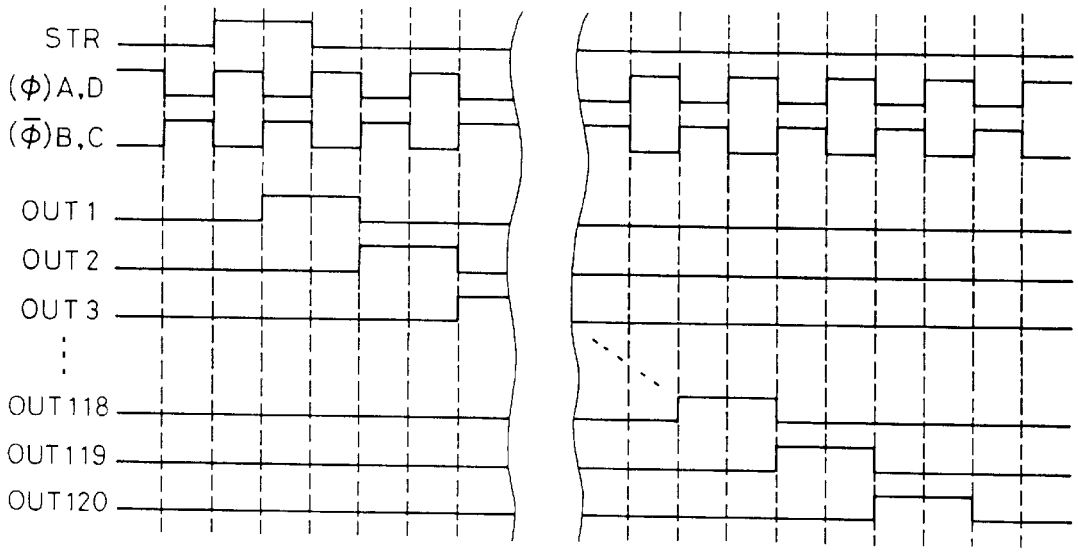
FIG. 8 is a timing chart showing the operation of the third embodiment of the scanning circuit according to the present invention.

The operation of the scanning circuit according to the present invention, as set forth above will be discussed hereinafter with reference to FIGS. 8 and 9. FIG. 8 is a timing chart showing the operation of the third embodiment of the scanning circuit in rightward shifting. In case of rightward shifting, the start pulse STR is input to the first input/output terminal 101 at the shown timing with setting the shifting direction switching control signal R at HIGH level and the control signal L at LOW level. On the other hand, the clock signals A and D are taken as a common clock signal $\phi$, and the clock signals B and C are taken as a common clock signal for $\bar{\phi}$.

By inputting such signal, output signals OUT1 to OUT120 having a pulse width of half of the clock period and shifted for half clock period in sequential order, are output. At this time, the pulse signal same as the output signal OUT120 is output from the second input/output terminal 102 through the rightward shifting output circuit 106.

Figure 9:
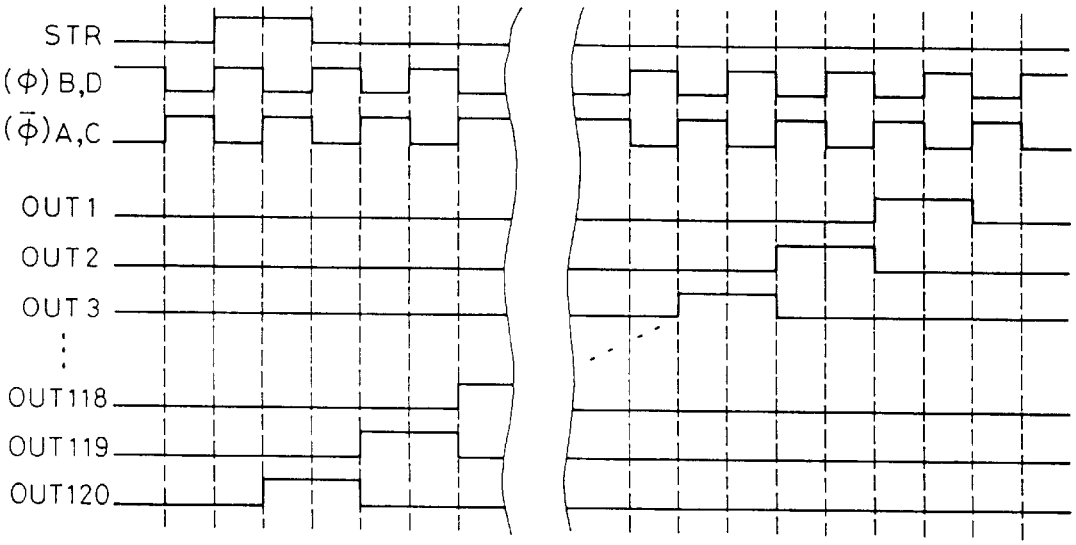
FIG. 9 is a timing chart showing the operation of the third embodiment of the scanning circuit according to the present invention.

On the other hand, FIG. 9 is a timing chart showing in the case of the leftward shifting in the shown embodiment of the scanning circuit according to the present invention. In case of the leftward shifting, the start pulse STR is input to the second input/output terminal 102 at the shown timing under the condition where the shifting direction switching control signal R is LOW level and the control signal L is HIGH level. On the other hand, the clock signals B and D are taken as a common clock signal $\phi$, and the clock signals A and C are taken as a common clock signal for $\bar{\phi}$.

By inputting such signal, output signals OUT120 to OUT1 having a pulse width of half of the clock period and shifted for half clock period in sequential order, are output. At this time, the pulse signal same as the output signal OUT1 is output from the first input/output terminal 101 through the leftward shifting output circuit 105.

On the other hand, it should be easily expected from the timing charts in FIGS. 8 and 9 that even in the case where the shown embodiment of a plurality of the scanning circuits are connected as application of the driver IC chip, the scanning pulse signal having no timing error can be lead out at the chip connecting portion similarly to the first embodiment.

In the shown embodiment, while the p-SiTFT fabricated through the low temperature process is employed as the transistor, it is also possible to employ the p-SiTFT fabricated through a high temperature process with maximum process temperature of 1000° C. On the other hand, other thin film transistor, such as amorphous silicon (a-Si) TFT, a cadmium-selenium (CdSe) TFT and so forth may be employed. Also, a single crystalline silicon MOS transistor may be employed.

On the other hand, while the driver IC consisted only by the scanning circuits are illustrated in the shown embodiment, the present invention is applicable for circuits, in which a sample/hold circuit, an analog amplifier, a latch circuit, a digital to analog converter or so forth is added to the scanning circuit of the invention.

Furthermore, while the switching element in C-MOS construction is employed as the transfer gate 109, the switching element in other construction may be employed.

In addition, while the foregoing embodiments has been discussed for the case where respective of a plurality of scanning circuit of FIGS. 1, 4 and 7 are connected as IC chips, it is of course possible to use the individual scanning circuit alone. Also, while number of nodes located between the output of the rightward shifting input circuit 103 and the input of the leftward shifting output circuit 105 (corresponding to number of shifting stage) is set at "2", the specific number as discussed is not limitative. However, it is necessary to make the number of shifting stages in leftward and rightward shifting directions same ($|L-Q|=|R-M|$) between the first and second input/output terminals 101 and 102. In addition, L, Q, R and M are selected to satisfy $|L-R|=|Q-M|=2$.

As set forth above, by applying the scanning circuit according to the present invention, even when a plurality of the scanning circuits are connected as the driver IC chip for a liquid crystal display, the malfunction signal will never appear. Also, since no timing error of the output pulse signal may be generated in the chip connecting portion, high speed bidirectional scanning circuit chip having high general applicability or the driver circuit including the scanning circuit can be provided.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A bidirectional scanning circuit comprising:

a plurality of switching means controlled to be turned ON and OFF by a clock signal and mutually connected in series;

a plurality of feedback means connected to respective series connecting points of respective of said switching means and being controlled activation by said clock signal, for preventing attenuation of amplitude of branched signals at respective series connecting points;

a plurality of buffer means for inputting outputs of said feedback means;

a plurality of logic gate means for inputting outputs of a (J)th (J is natural number) and (J+1)th buffer means;

first and second input/output terminals for inputting and outputting a start pulse for initiation of scanning;

assuming sequential K (K is an integer greater than or equal to 6) in number of series connecting points of said switching means being N(1) to N(K−1) from the ends and assuming that the terminals at both ends are N(0) and N(K), first direction shifting input means connected between said first input/output terminal and a terminal of N(L)th order (L is an integer of $0 \leqq L \leqq K-6$);

second direction shifting output means connected between said first input/output terminal and a terminal of N(R)th order (R is an integer of $0 \leqq R \leqq K-6$);

second direction shifting input means connected between said second input/output terminal and a terminal of N(M)th order (M is an integer of $6 \leqq M \leqq K$);

first direction shifting output means connected between said second input/output terminal and a terminal of N(Q)th order (Q is an integer of $6 \leqq Q \leqq K$, $|L-Q|=|R-M|$); and a plurality of scanning output terminals leading out respective output pulses of said logic gate means of G(L+1) to G(M−2) as taking said logic gate means as G(1) to G(K−1) in sequential order from said end.

2. A bidirectional scanning circuit as set forth in claim 1, wherein said switching means is a transfer gate element controlled to turn ON and OFF by a two phase signal as complementary signal of said clock signal.

3. A bidirectional scanning circuit employing a plurality of bidirectional scanning circuits defined in claim 1, with establishing a cascade connection by connecting said second input/output terminal of one scanning circuit with said first input/output terminal of other scanning circuit for inputting said start pulse from said first input/output terminal of said scanning circuit at the first stage or said second input/output terminal of said scanning circuit at the final stage.

4. A bidirectional scanning circuit as set forth in claim 1, wherein said L, Q, R and M are selected to satisfy $|L-R|=|Q-M|=2$.

5. A bidirectional scanning circuit as set forth in claim 1, which is for a liquid crystal display.

6. A bidirectional scanning circuit as set forth in claim 5, wherein each of said switching means, said feedback means, said buffer means and said logic gate means is constructed by a thin film transistor element.

7. A bidirectional scanning circuit comprising:

a plurality of switching means controlled to be turned ON and OFF by a clock signal and mutually connected in series;

a plurality of feedback means connected to respective series connecting points of respective of said switching means and being controlled activation by said clock signal, for preventing attenuation of amplitude of branched signals at respective series connecting points;

a plurality of buffer means for inputting outputs of said feedback means;

first and second input/output terminals for inputting and outputting a start pulse for initiation of scanning;

assuming sequential K (K is an integer greater than or equal to 6) in number of series connecting points of said switching means being N(1) to N(K−1) from the ends and assuming that the terminals at both ends are N(0) and N(K), first direction shifting input means connected between said first input/output terminal and a terminal of N(L)th order (L is an integer of $0 \leqq L \leqq K-6$);

second direction shifting output means connected between said first input/output terminal and a terminal of N(R)th order (R is an integer of $0 \leqq R \leqq K-6$);

second direction shifting input means connected between said second input/output terminal and a terminal of N(M)th order (M is an integer of $6 \leqq M \leqq K$);

first direction shifting output means connected between said second input/output terminal and a terminal of N(Q)th order (Q is an integer of $6 \leqq Q \leqq K$, $|L-Q|=|R-M|$); and a plurality of scanning output terminals leading out respective output pulses of said buffer means of G(L+2) to G(M−2) as taking said buffer means as G(1) to G(K−1) in sequential order from said end.

8. A bidirectional scanning circuit as set forth in claim 7, wherein said switching means is a transfer gate element controlled to turn ON and OFF by two phase signals as complementary signal of said clock signal.

9. A bidirectional scanning circuit employing a plurality of bidirectional scanning circuits defined in claim 7, with establishing a cascade connection by connecting said second input/output terminal of one scanning circuit with said first input/output terminal of other scanning circuit for inputting said start pulse from said first input/output terminal of said scanning circuit at the first stage or said second input/output terminal of said scanning circuit at the final stage.

10. A bidirectional scanning circuit as set forth in claim 7, wherein said L, Q, R and M are selected to satisfy $|L-R|=|Q-M|=2$.

* * * * *